US008658932B2

(12) United States Patent
Schellekens et al.

(10) Patent No.: US 8,658,932 B2
(45) Date of Patent: Feb. 25, 2014

(54) DEVICE FOR DETECTING VACUUM LOSS IN A VACUUM BREAKING APPARATUS AND VACUUM BREAKING APPARATUS COMPRISING ONE SUCH DEVICE

(75) Inventors: Hans Schellekens, La Terrasse (FR); Serge Olive, Saint Paul de Varces (FR); Jean Pierre Gauthier, Vourey (FR)

(73) Assignee: Schneider Electric Industries SAS, Rueil-Malmaison (FR)

( * ) Notice: Subject to any disclaimer, the term of this patent is extended or adjusted under 35 U.S.C. 154(b) by 270 days.

(21) Appl. No.: 13/373,392

(22) Filed: Nov. 14, 2011

(65) Prior Publication Data

US 2012/0145674 A1 Jun. 14, 2012

(30) Foreign Application Priority Data

Dec. 9, 2010 (FR) ..... 10 04796

(51) Int. Cl.
*H01H 33/66* (2006.01)

(52) U.S. Cl.
USPC ..... 218/122; 340/626

(58) Field of Classification Search
USPC ..... 218/118–124; 340/626
See application file for complete search history.

(56) References Cited

U.S. PATENT DOCUMENTS

| | | | | |
|---|---|---|---|---|
| 4,103,291 | A | 7/1978 | Howe et al. | |
| 4,398,187 | A * | 8/1983 | Fukushima et al. | 340/626 |
| 4,491,704 | A * | 1/1985 | Milianowicz et al. | 218/122 |
| 4,547,769 | A * | 10/1985 | Tanigaki et al. | 340/626 |
| 4,553,139 | A * | 11/1985 | Tanigaki et al. | 340/626 |
| 6,153,846 | A * | 11/2000 | Morita et al. | 218/122 |
| 7,383,733 | B2 * | 6/2008 | Mosely et al. | 73/602 |
| 7,802,480 | B2 * | 9/2010 | Mosely et al. | 73/700 |

FOREIGN PATENT DOCUMENTS

| | | |
|---|---|---|
| DE | 3702009 A1 | 8/1988 |
| JP | 10-92277 | 4/1998 |

* cited by examiner

*Primary Examiner* — Truc Nguyen
(74) *Attorney, Agent, or Firm* — Steptoe & Johnson LLP

(57) ABSTRACT

A device for detecting vacuum loss in a vacuum breaking apparatus that includes an enclosure having a first part at least partially of insulating material, closed at its opposite ends by end-plates, and housing fixed and mobile electrodes. A second part of the enclosure is insulating material at least partially around the first part, this second part is an over-molding of electrically grounded conductive shielding at least a part of its outer surface. This first strip of over-molding faces both the first part and one of the electrodes, thereby providing two capacitances in series, namely, a vacuum capacitance between the electrode and the inner surface of the first part, and a solid capacitance between the inner surface of the first part and the first strip, and means for measuring change of current value in the first strip, which corresponds to a vacuum loss inside a vacuum breaking apparatus.

13 Claims, 5 Drawing Sheets

Figure 1:
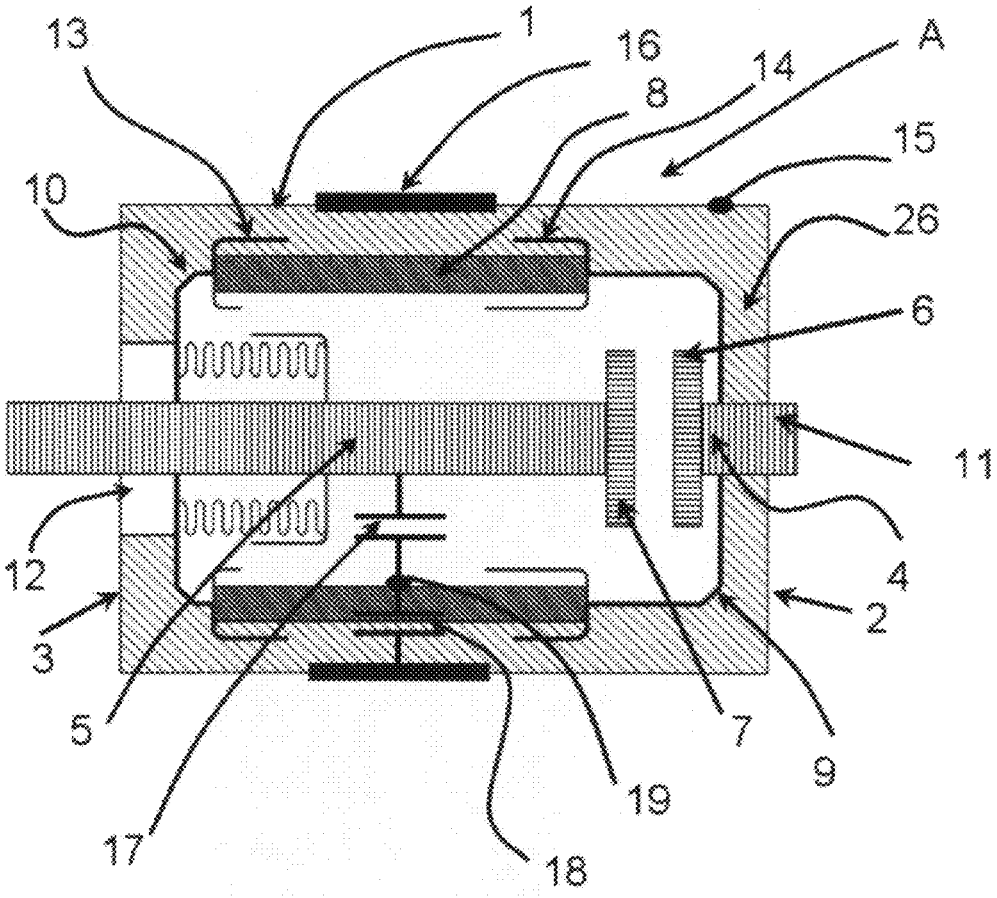

DEVICE FOR DETECTING VACUUM LOSS IN A VACUUM BREAKING APPARATUS AND VACUUM BREAKING APPARATUS COMPRISING ONE SUCH DEVICE

The present invention relates to a device for detecting vacuum loss in a vacuum breaking apparatus, said apparatus being situated in an electrically supplied primary power system and comprising an enclosure comprising a first part of substantially cylindrical shape at least partially made from an insulating material such as ceramic, said first part being closed at its two opposite ends by two end-plates, said enclosure housing a fixed electrode securely attached to one of the above-mentioned end-plates and supporting a stationary contact, and a mobile electrode supporting a movable contact, said mobile electrode being mounted in sliding manner through the other of the two end-plates between a closed position of the apparatus in which the movable contact is in contact with the stationary contact and an open position of the apparatus in which the movable contact is separated from the stationary contact, as well as to a vacuum breaking apparatus comprising one such device.

The document U.S. Pat. No. 4,103,291 describing a device of the above-mentioned kind applied to a cartridge comprising a floating shield is known. In this device, a capacitance is placed between the reflecting shield and one of the electrodes inside the cartridge and is used to measure the state of the vacuum in the cartridge.

If the state of the vacuum is correct, the dielectric strength in the cartridge is such that almost all of the voltage is located between the electrode and the shield.

If the quality of the vacuum is poor, the gas that has entered the cartridge reduces the dielectric strength inside the cartridge and arc flashovers occur between the electrodes and shield. The current flowing in the electric circuit connecting the electrodes in series to the floating shield is then measured, the measured current being an image of the state of the vacuum inside the cartridge.

Application of this device is limited to cartridges having a floating shield inside the cartridge. For other cartridges, such as cartridges called asymmetric which do not have a floating shield, this type of detector is not able to be used.

The present invention overcomes this drawback and proposes a device for detecting vacuum loss in a vacuum breaking apparatus such as a cartridge that is of simple design and can be applied both to cartridges with a floating shield and in asymmetric cartridges for example.

For this purpose, one object of the present invention is to provide a device for detecting vacuum loss of the above-mentioned kind, this device being characterized in that said enclosure comprises a second part made from insulating material and placed at least partially around the above-mentioned first part, this second part comprising a layer of electrically earthed conducting material forming a shielding on at least a part of its outer surface, in that a strip called first strip of this layer of conducting material is insulated from the rest of said layer, this strip called first strip being located facing both the first insulating part and either the fixed electrode or the mobile electrode, this strip called first strip forming a capacitance composed of two capacitances in series, respectively a capacitance called vacuum capacitance located between the mobile or fixed electrode and the inner surface of the first insulating part, and a capacitance called solid capacitance fitted between the inner surface of the above-mentioned first insulating part and the strip called first strip, and means for measuring the current flowing in the strip called first strip connected to indicating means, a certain change in the value of the current value translating a change of value of the vacuum capacitance, which change translates a vacuum loss inside the vacuum breaking apparatus.

According to another feature, said vacuum breaking apparatus comprising a shield electrically connected to the mobile or fixed electrode and partially surrounding the mobile or fixed electrode, this apparatus is characterized in that, inside the layer of above-mentioned conducting material, a second strip of conducting material is insulated from the rest of the above-mentioned conducting layer and also from the above-mentioned first strip, this second strip being located facing said screen and forming a capacitance called third capacitance between the second strip and said shield, said capacitance called third capacitance being dimensioned in such a way that its value is equal to the value of the above-mentioned two capacitances called first and second capacitances connected in series, and means for measuring the voltage between the two strips, a change of value of the vacuum capacitance resulting from a loss of vacuum inside the apparatus resulting in a change of value of the current flowing in the first strip, this difference between the two current values resulting in a differential voltage between the two strips, and means for indicating a certain differential voltage value.

According to a particular feature of this embodiment, the width of the strip called first strip is a maximum of 20 mm so that the value of the current measured at the terminals of the first strip in case of leakage is about 10 μA for a signal-to-noise ratio of 10 dB.

According to another embodiment, said apparatus comprising a first shield electrically connected to the mobile or fixed electrode and a second shield electrically connected to the fixed or mobile electrode, said shields at least partially surrounding the mobile or respectively fixed electrode, said apparatus is characterized in that, inside the layer of above-mentioned conducting material, a second strip and a third strip of conducting material are insulated from the rest of the above-mentioned conducting layer and also from the above-mentioned first strip, the second and third strips being respectively located facing the first and second shields and forming a capacitance called third capacitance and a capacitance called fourth capacitance respectively between the strip called second strip and said first shield and between the strip called third strip and said second shield, said capacitances called third and fourth capacitances being dimensioned in such a way that their value is equal to the value of the two capacitances called first and second capacitances connected in series, in that the strips called second and third strips are electrically connected to one and the same point where the current called second and third currents flowing in these two strips are added to one another to give a current called fourth current, and means for measuring the differential voltage generated by the difference between the two current values respectively the current called above-mentioned fourth current and the current called first current flowing in the first strip.

According to a particular feature, the width of the strip called first strip is adjusted in such a way that the value of the current measured at the terminals of the first strip is greater than 16 μA for a signal-to-noise ratio of 20 dB.

According to another feature, this apparatus comprises an electronic circuit controlled by the above-mentioned differential voltage and controlling means for indicating a certain differential voltage value, said differential voltage value being representative of a vacuum loss inside the vacuum breaking apparatus.

According to another feature, each of these two strips is electrically earthed by an impedance, an impedance circuit comprising a differential switch being connected to the terminals of these impedances.

According to a particular feature, the above-mentioned means for indicating comprise a differential switch and/or a fuse and/or a detonator and/or means for demagnetizing a magnet and/or means for discolouring a conductive strip made from organic material.

According to another feature, the electronic circuit comprises a charge circuit by accumulation which is sufficiently slow so as not to react to transient voltage surges in the primary electric power system, but which is sufficiently fast to act within the few hours or within the day following the vacuum loss.

It is a further object of the present invention to provide a vacuum switch comprising a vacuum loss detection device comprising the above-mentioned features taken either alone or in combination.

According to a particular feature, this vacuum switch is a vacuum cartridge.

According to a particular feature, this cartridge is housed in an enclosure on which an insulating material is over-moulded, the outer surface of the over-moulded part of the enclosure being metallized, said metallization layer being earthed and forming a shielding.

It is yet a further object of the present invention to provide a vacuum cartridge further comprising a floating shield fitted around the electrodes and contacts, said cartridge comprising a vacuum loss detection device comprising the above-mentioned features taken either alone or in combination, of the type comprising a single strip.

Figure 2:
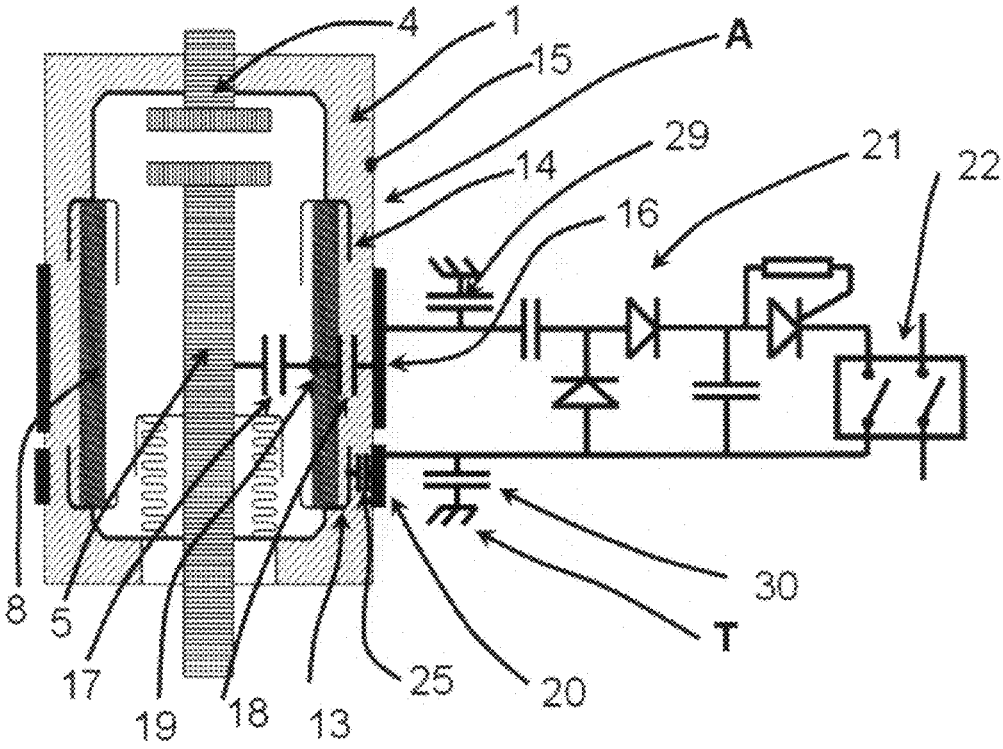
Figure 3:
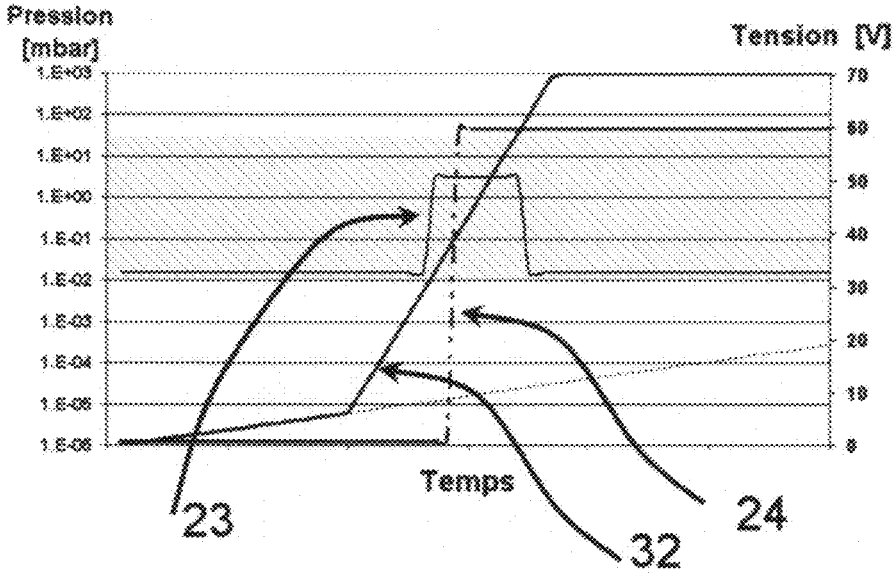
Figure 4:
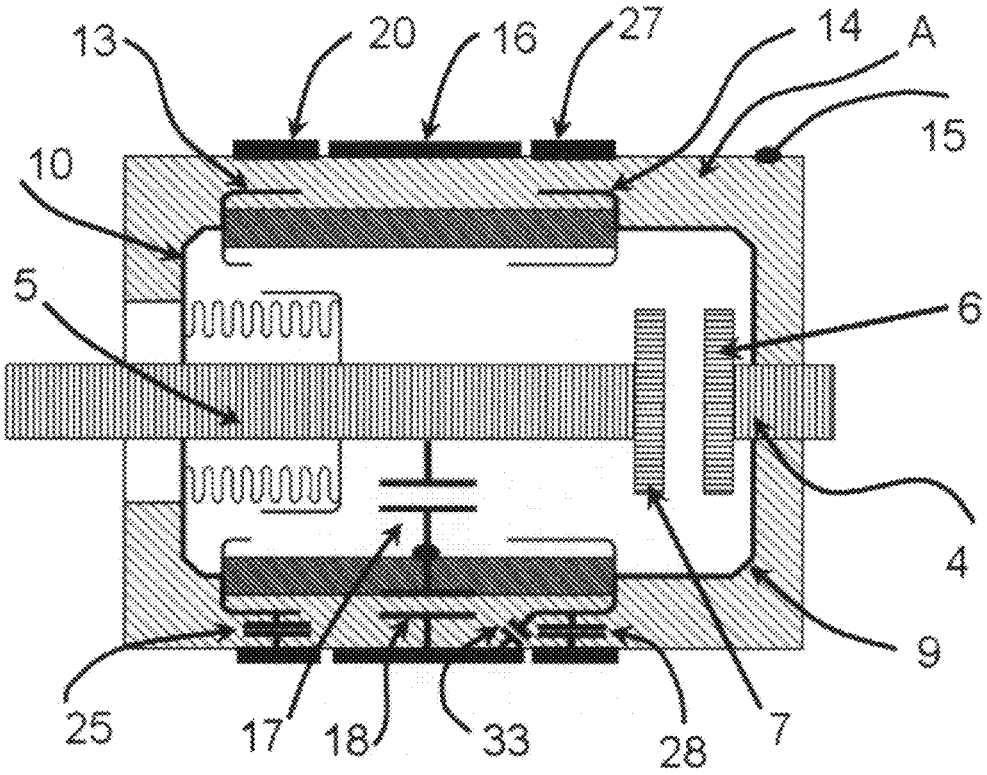
Figure 5:
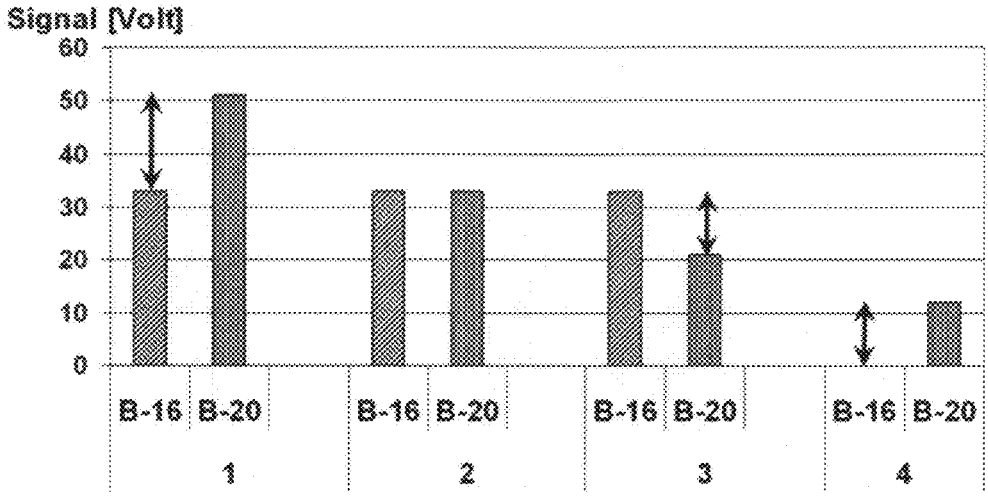
Figure 6:
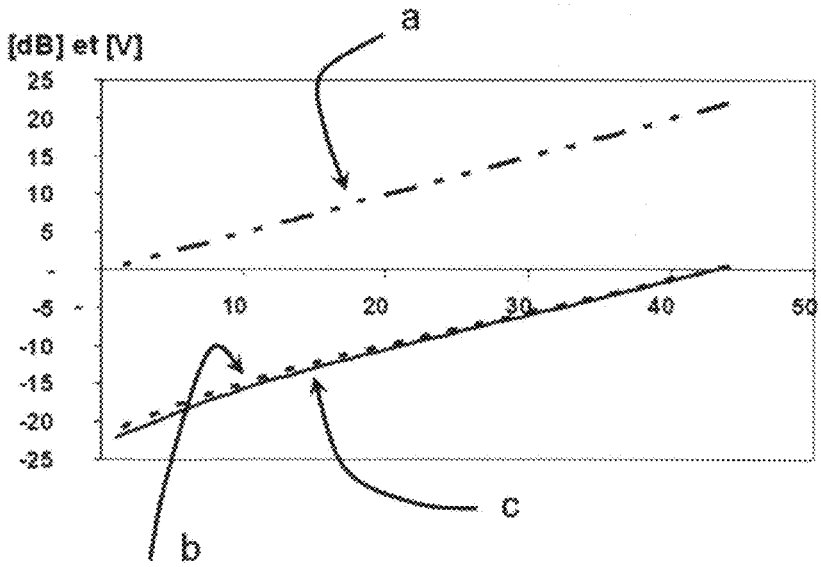

But other advantages and features of the invention will become more clearly apparent from the following detailed description which refers to the accompanying drawings given for example purposes only and in which:

FIG. 1 is an axial cross-sectional view illustrating a vacuum cartridge according to a particular embodiment of the invention, FIG. 2 is an axial cross-sectional view illustrating a vacuum cartridge according to a second embodiment of the invention, FIG. 3 is a graphic representation illustrating two signals respectively representative of the currents flowing in the two strips, FIG. 4 illustrates a vacuum cartridge according to a third embodiment of the invention, FIG. 5 is a diagram representative of the differential voltage between the currents of two strips, as far as the second embodiment of the invention is concerned, for four different positions of the cartridge, and FIG. 6 is a diagram representing the signal at the terminals of the first strip according to the width of the first strip.

In FIG. 1, a first embodiment of a vacuum cartridge A according to the invention is represented comprising, in a manner known as such, an enclosure 1 of substantially cylindrical shape closed by two end-plates 2,3. The enclosure contains a fixed electrode 4 fixed with respect to said enclosure, and a mobile electrode 5 movable with respect to said enclosure, the two electrodes 4,5 respectively each supporting a stationary contact 6 and a movable contact 7 at their free end, said mobile electrode 5 being movable between a contact position of the two contacts 6,7 and a separated position of the two contacts.

The enclosure 1 comprises a cylindrical part 8 made from ceramic closed by two end covers 9,10 through which the above-mentioned two electrodes 4,5 respectively pass, said electrodes being respectively supported by two extensions 11,12. The cartridge 1 also comprises two conducting shields 13,14 electrically connected for one shield 13 to the mobile electrode 5 and for the other shield 14 to the fixed electrode 4, these shields being located at the level of the junction between the end covers 9,10 and the ceramic insulating part 8 of the enclosure.

The assembly formed by the ceramic part 8, the end covers 9,10 and at least partially the interfaces 2,3 is over-moulded by an epoxy material 26 to provide an enhanced insulation of said enclosure. The outer part of the over-moulded epoxy part is metallized and this metallization is earthed so as to form a shielding. The interfaces on the right and on the left 2,3 are non-metallized surfaces and act as interface with other parts of the apparatus which are not visible here. In the epoxy metallization layer 15, a first strip 16 of cylindrical shape is insulated from the rest of the metallized surface 15. This first strip 16 forms a capacitance composed of two capacitances in series 17,18. Firstly, a first capacitance called vacuum capacitance 17, placed between the mobile electrode 5 and the inner surface 19 of the ceramic part 8, and a capacitance 18 called solid capacitance, placed between the inner surface 19 of the ceramic part 8 and the insulated metallization strip called first strip 16.

When a vacuum loss occurs inside the cartridge, the dielectric strength between the mobile electrode 5 and the ceramic part 8 decreases and flashovers short-circuit the vacuum capacitance 17. When the cartridge is located in an electrically supplied primary power system, this change in the value of the vacuum capacitance results in a change of the value of the current flowing in the insulated strip called first strip 16.

The state of the vacuum in the cartridge can therefore be monitored by measuring the value of this current.

In this device however, the value of the current varies little with the pressure. This measurement therefore does not enable a difference to be made between a vacuum loss and an earth fault in the primary electric power system.

A cartridge according to a second embodiment of the invention as represented in FIG. 2 enables this problem to be overcome.

In this second embodiment, the cartridge A comprises the same elements as those already described in the previous embodiment, but a second strip 20 of the metallization layer 15 is insulated from the rest of the metallized surface. This second strip 20 is situated around that 13 of the above-mentioned conducting shields 13,14, which is situated on the opposite side to the fixed electrode 4 and which is therefore electrically connected to the mobile electrode 5. This second strip 20 creates a capacitance 25 called third capacitance between said strip 20 and said shield 13 electrically connected to the mobile electrode 5.

This capacitance 25 is dimensioned in such a way that its value is equal to the value of the capacitance formed by the two capacitances 17,18 in series. Each of these two strips 16,20 is electrically connected to earth T (to be indicated in the figures) by an impedance 29,30 represented here by a capacitance. An impedance circuit 21 comprising a differential switch 22 is connected to the terminals of these two impedances 29,30. Thus, in the presence of a leak inside the cartridge, a differential voltage is created between the two strips 16,20 at the terminals of these impedances 29,30. This voltage is zero or close to zero in the case of a good state of the vacuum inside the cartridge, as the currents flowing in the two strips 16,20 are almost identical. In the presence of a vacuum loss inside the cartridge A on the other hand, the dielectric strength between the mobile electrode 5 and ceramic part 8 decreases and flashovers occur which short-circuit the vacuum capacitance 17. This change in the value of the vacuum capacitance 17 results in a change of value of the current flowing in the first strip 16. This difference between the currents respectively flowing in the two strips 16,20 produces a voltage between the two strips, this differential voltage enabling an electronic circuit 21 to be commanded controlling opening of the above-mentioned differential switch 22.

The electronic circuit 21 contains a charge circuit by accumulation which is sufficiently slow so as not to react to transient voltage surges in the primary electric power system, but which is sufficiently fast to act within the few hours or within the day following the vacuum loss.

This period is shorter than the duration of the flashovers inside the cartridge which depend on the size of the leak, as illustrated in FIG. 3 illustrating the modification of the pressure 32 versus time, the duration of which is about 2 to 20 days.

A thyristor discharges energy into a differential switch for the purpose of causing a change of state which will keep the vacuum loss of the cartridge in memory even if the latter is no longer supplied by the primary power system.

This differential measurement thus enables the information related to the power system voltage to be separated from that related to the state of the vacuum in the cartridge so as to only measure a signal related to a vacuum loss in the cartridge.

The voltage level at the electrodes is thereby circumvented by a differential measurement.

In FIG. 3, the first signal 23 represents the differential voltage at the terminals of the impedances 29,30 due to temporary passage of the cartridge in the low dielectric strength area in which internal flashovers have occurred for 2 to 20 days.

The second signal 24 represents the change of state of the differential switch or 0 state represents the closed position and 1 state represents the open position, which change of state will be visible at any time afterwards.

This detection gives a visibility of the state of the cartridge when performing operations on the apparatus even if no voltage is present either from the primary power supply system of the cartridge or from the secondary power supply system in the substation.

It should be noted that the first strip 16 should be placed facing the ceramic part 8 and facing the mobile electrode 5 or fixed electrode 4. The second strip 20 should for its part be located facing one of the conducting shields 13,14, and therefore either the mobile electrode 5 or fixed electrode 4.

Preferably, when there are two strips, the second strip 20 has to be located facing the shield connected to the mobile electrode.

The second strip 20 performs compensation of the signal in the absence of a leak in the closed position of the contacts, i.e. in this case the currents flowing in the two strips are substantially identical, as illustrated in FIG. 5 in position 2. On the other hand, in the case corresponding to an open position of the movable contact without electric supply to the stationary contact (position 3 in FIG. 5), and in the case corresponding to an open position of the movable contact without electric supply to the movable contact (position 4 in FIG. 5), a differential voltage is observed, which results in it being difficult to distinguish between these two cases in the presence of a leak when the contacts are closed (position 1). Indeed, in case 3 of FIG. 5, which corresponds to an open position of the movable contact without electric power supply from the stationary contact, the second strip 20 overcompensates the capacitive current in the first strip 16, whereas for case 4 corresponding to an open position of the movable contact without electric power supply to the movable contact, this second strip no longer receives any current due to the absence of capacitive coupling with the stationary contact.

To overcome this problem, the width of the first strip can be adjusted so as not to exceed 20 mm in order to obtain a current value signal of about 10 μA for a signal-to-noise ratio of 10 dB. This enables the selectivity to be improved to the detriment of the signal. Below 20 mm, the nuisance will be less than −10 dB for a signal close to 10 μA as illustrated in FIG. 6.

In this figure, curve plot a represents the signal in μA versus the width of the first strip in mm, and curve plots b and c respectively represent the signal-to-noise ratios in case of open movable contact with an electric power supply only of the movable contact or of the stationary contact, according to the width of the first strip.

According to the embodiment illustrated in FIG. 4, the cartridge comprises a first measuring strip 16 located substantially in the centre, facing the ceramic part 8 and the mobile electrode 5, a separate second strip 20 of conducting material surrounding the first shield 13 electrically connected to the mobile electrode, and a third strip 27 of conducting material located on the same side as the stationary contact 4, surrounding the second shield 14 electrically connected to the stationary contact 4.

By means of this third strip 27, a fourth capacitance 28 is formed between said third strip 27 and the second shield 14. This strip enables the parasite signals caused by the small capacitance 33 between the first strip 16 and the shield 14 to be compensated. The capacitances called third capacitance 25 and fourth capacitance 28 are dimensioned in such a way that the value of the total capacitance they form, being connected in parallel, is equal to the value of the capacitance formed by the assembly formed by the two capacitances 17,18 connected in series, these two capacitances 17,18 being connected in parallel with the capacitance 33.

In this embodiment, the above-mentioned second and third strips are electrically connected to the same point where the currents called second and third current respectively flowing in these two strips are added to one another to give a current called fourth current. The device then comprises means for measuring the differential voltage between the current flowing in the first strip, called first current, and the above-mentioned current called fourth current. This differential voltage will then be able to supply an electronic circuit as described in the previous embodiment, which circuit will actuate indicating means.

The advantage of this third strip is to improve the sensitivity of measurement in the case where the contacts 6 and 7 are open and a primary voltage is applied on the side where the stationary contact 6 is located.

According to the latter embodiment, the width of the strips should preferably be chosen such that the current value of the signal is greater than 16 μA for a signal-to-noise ratio of 20 dB. Compensation of the signal will thereby be obtained even in the case where the movable contact is open or the stationary contact is open in the cartridge.

Thus, according to this embodiment, detection of a differential voltage of a certain value will be representative of a leak inside the cartridge.

This device is applicable to any type of cartridge comprising an enclosure comprising a part made from ceramic or from any material presenting similar dielectric characteristics.

This device is for example applicable to cartridges such as cartridges of floating shield type, the first strip having to be placed facing the ceramic and facing the mobile or fixed electrode.

It should also be noted that the differential switch can be replaced by other devices enabling a change of state to be visualized such as a fuse or detonator, a demagnetisation means of a magnet such as a Mi-top, means for discolouring a conducting strip of organic material, etc.

The invention is naturally in no way limited to the embodiments described and illustrated which have been given for example purposes only.

On the contrary, the invention extends to encompass the technical equivalents of the means described as well as combinations thereof if the latter are achieved according to the spirit of the invention.

The invention claimed is:

1. A device for detecting vacuum loss in a vacuum breaking apparatus, said apparatus being situated in an electrically supplied primary power system and comprising an enclosure, the enclosure comprising:

a first part of substantially cylindrical shape at least partially made from an insulating material such as ceramic, said first part being closed at its two opposite ends by two end-plates, said enclosure housing a fixed electrode securely attached to one of the above-mentioned end-plates and supporting a stationary contact, and a mobile electrode supporting a movable contact, said mobile electrode being mounted in sliding manner through the other of the two end-plates between a closed position of the apparatus in which the movable contact is in contact with the stationary contact and an open position of the apparatus in which the movable contact is separated from the stationary contact;

a second part made from insulating material and placed at least partially around the first part, this second part comprising a layer of electrically earthed conducting material forming a shielding on at least a part of its outer surface, a first strip of conducting material is insulated from the rest of said layer, the first strip being located facing both the first insulating part and either the fixed or mobile electrode, the first strip forming a capacitance composed of a first and a second capacitances in series;

wherein the first capacitance is a vacuum capacitance located between the mobile or fixed electrode and the inner surface of the first part; and wherein the second capacitance is a solid capacitance fitted between the inner surface of the first part and the first strip; and means for measuring the current flowing in the first strip connected to indicating means, a certain change in the value of the current value translating a change of value of the vacuum capacitance, which change translates a vacuum loss inside the vacuum breaking apparatus.

2. The device for detecting vacuum loss according to claim 1, said apparatus comprising a shield electrically connected to the mobile or fixed electrode and partially surrounding the mobile or fixed electrode, wherein, inside the layer of conducting material, a second strip of conducting material is insulated from the rest of the conducting layer and also from the first strip, this second strip being located facing said screen and forming a third capacitance between the second strip and said shield, said third capacitance being dimensioned in such a way that its value is equal to the value of the first and second capacitances connected in series, and means for measuring the voltage between the first and second strips, a change of value of the vacuum capacitance resulting from a loss of vacuum inside the apparatus resulting in a change of value of the current flowing in the first strip, this difference between the two current values resulting in a differential voltage between the first and second strips, and means for indicating a certain differential voltage value.

3. The device for detecting vacuum loss according to claim 2, wherein the width of the first strip is a maximum of 20 mm so that the value of the current measured at the terminals of the first strip in case of leakage is about 10 pA for a signal-to-noise ratio of 10 dB.

4. The device for detecting vacuum loss according to claim 1, said apparatus comprising a first shield electrically connected to the mobile or fixed electrode, and a second shield electrically connected to the fixed or mobile electrode, said shields at least partially surrounding the mobile or respectively fixed electrode, wherein, inside the layer of conducting material, a second and third strip of conducting material are insulated from the rest of the conducting layer and also from the first strip, these second and third strips being respectively located facing the first and second shields and forming a third capacitance and a fourth capacitance respectively between the second strip and said first shield and between the third strip and said second shield, said third and fourth capacitances being dimensioned in such a way that their value is equal to the value of the first and second capacitances connected in series, wherein the second and third strips are electrically connected to one and the same point where the second and third currents flowing in these two strips are added to one another to give a fourth current, and means for measuring the differential voltage generated by the difference between the two current values respectively the fourth current and the first current flowing in the first strip.

5. The device for detecting vacuum loss according to claim 4, wherein the width of the first strip is adjusted so that the value of the current measured at the terminals of the first strip is greater than 16 μA for a signal-to-noise ratio of 20 dB.

6. The device for detecting vacuum loss according to claim 2, comprising an electronic circuit controlled by the differential voltage and controlling means for indicating a certain differential voltage value, said differential voltage value being representative of a vacuum loss inside the vacuum breaking apparatus.

7. The device for detecting vacuum loss according to claim 2, wherein each of the first and second strips is electrically earthed by an impedance, an impedance circuit comprising a differential switch being connected to the terminals of these impedances.

8. The device for detecting vacuum loss according to claim 6, wherein the indicating means comprise a differential switch and/or a fuse and/or a detonator and/or means for demagnetizing a magnet and/or means for discoloring a conductive strip made from organic material.

9. The device for detecting vacuum loss according to claim 6, wherein the electronic circuit comprises a charge circuit by accumulation which is sufficiently slow so as not to react to transient voltage surges in the primary electric power system, but which is sufficiently fast to act within the few hours or within the day following the vacuum loss.

10. A vacuum switch comprising a device for detecting vacuum loss according to claim 1.

11. The vacuum switch according to claim 10, wherein it is a vacuum cartridge.

12. The vacuum switch according to claim 11, wherein said cartridge is housed in an enclosure on which an insulating material is over-moulded, the outer surface of the over-moulded part of the enclosure being metallized, said metallization layer being earthed and forming a shielding.

13. A vacuum cartridge further comprising a floating shield fitted around the electrodes and the contacts, said cartridge comprising a device for detecting vacuum loss according to claim 1.

* * * * *